US007597450B2

(12) United States Patent
Garrett

(10) Patent No.: US 7,597,450 B2
(45) Date of Patent: Oct. 6, 2009

(54) INDUCTION FLUORESCENT LIGHT FIXTURE

(75) Inventor: Clayton M. Garrett, Mariposa, CA (US)

(73) Assignee: American Wholesale Lighting, Inc., Fremont, CA (US)

( * ) Notice: Subject to any disclaimer, the term of this patent is extended or adjusted under 35 U.S.C. 154(b) by 20 days.

(21) Appl. No.: 11/803,198

(22) Filed: May 14, 2007

(65) Prior Publication Data

US 2008/0285263 A1 Nov. 20, 2008

(51) Int. Cl.
*F21V 7/10* (2006.01)

(52) U.S. Cl. ..... 362/216; 362/221; 362/373

(58) Field of Classification Search ..... 362/147, 362/216, 218, 221, 225, 260, 294, 373, 404; 313/318.11
See application file for complete search history.

(56) References Cited

U.S. PATENT DOCUMENTS

| | | | | |
|---|---|---|---|---|
| 6,565,238 | B1 * | 5/2003 | Pyrtle | 362/373 |
| 6,601,975 | B1 * | 8/2003 | Haugaard et al. | 362/404 |
| 2007/0115654 | A1 * | 5/2007 | Ruben | 362/221 |
| 2008/0030118 | A1 * | 2/2008 | Ham | 313/318.11 |

* cited by examiner

*Primary Examiner*—Y My Quach Lee
(74) *Attorney, Agent, or Firm*—Ernest McCoy; Bruce & McCoy

(57) ABSTRACT

A high bay induction fluorescent lighting fixture having a multiple of nested circular lamps suspended on a post below the ballasts therefor and enclosed in a reflector.

14 Claims, 7 Drawing Sheets

INDUCTION FLUORESCENT LIGHT FIXTURE

BACKGROUND OF THE INVENTION

1. Field of the Invention

The present invention relates to an apparatus for providing an improved fluorescent light fixture with optimized illumination performance most usually employed for industrial and commercial applications.

More particularly the present invention provides a means for utilizing induction fluorescent lighting lamps for high bay industrial styled lighting fixtures as well as other applications.

Still more particularly the present invention provides a new and novel apparatus for integrating single or multiple induction fluorescent lamps into a preferred configuration lighting fixture which provides maximum downward light dispersion from the assembled lamps.

Specifically the present invention provides a new and novel lighting fixture for integrating a single or multiple of variable induction fluorescent lamps into a single unit with the required ballasts and reflector for optimum downward illumination to provide the longest lived high bay lighting fixture heretofore developed.

2. Description of the Prior Art

The use of modern forms of electrical lighting in one form or another, particularly fluorescent lighting, and in multiple configurations, for the purpose of illuminating industrial workspace is widespread and well established in the prior art. However, despite the numerous types of electrical lighting fixtures disclosed by and utilized in the prior art, which have particularly been developed for the specific objectives and express purpose and requirements of high bay industrial lighting for manufacturing, distribution, assembly, storage etc., the fluorescent lighting apparatus which has been heretofor devised and utilized to accomplish this goal consists basically of familiar, expected, and obvious configurations, combinations, and arrangements of highly developed but universal lighting apparatus. This will become apparent from the following consideration of the advantages and disadvantages of the closest known and relevant prior art set forth infra.

Incandescent lighting: the advantages are that the lamps and fixtures are inexpensive and simple to install. No ballast is required as with fluorescent lighting, and the lights are instant on and off. Emergency performance is easy to initiate when power shuts off. There is high color rendering in the illumination and the lights are in inherently dimmable.

These advantages are offset by short lamp life and inefficient energy consumption. They provide lower lumen production per lamp which means limited use in high bay work spaces. The lower voltage utilized (120v, 130v) means fewer fixtures on a circuit, and the lamps generate heat.

Mercury vapor lighting: the advantages are long lamp life and provide highly efficient lumen generation. The lamps are capable of utilizing higher voltages (120v, 208v, 240v, 277v, & 480v) which allows for more lamps on a circuit. Higher lumen output allows for higher mounting height.

The disadvantages are: very bad color rendering; long strike time to illuminate; long re-strike time; expensive fixtures and lamp costs; ineffectual emergency lighting; and heat generation.

High-pressure sodium lighting: the advantages are long life for the lamp; efficient power utilization; low lumen depreciation over time; high lumen output; and higher voltage capability (120v, 208v, 240v, 277v, & 480v) which allows for more units on a circuit.

The disadvantages are: low color rendition; long strike time to illuminate; long re-strike time; expensive fixture and lamp costs; glare from the lamp; ineffectual emergency lighting; and heat generation.

Metal halide lighting (probe start): the advantages are excellent color rendition; high lumen output; long lamp life; energy efficiency; and higher voltage capability (120v, 208v, 240v, 277v, & 480v) allows more units on a circuit.

The disadvantages are: color shifting over life; lumen depreciation over time; long strike time to illuminate; long re-strike time; expensive lamp and fixture costs; glare from the lamp; ineffectual emergency lighting; and heat generation.

Ceramic metal halide (pulse start): the advantages are excellent color rendition; reduced strike and re-strike time; reduced color shift and reduced lumen depreciation over probe start metal halide lighting; long life and energy efficient; higher voltage capability, as with probe start metal halide lighting, allows more units on a circuit.

The disadvantages are: high cost; glare from the lamp; ineffectual emergency lighting; and heat generation.

Compact fluorescent: the advantages are instant on; long life and energy efficiency; variable color temperatures; multiple levels of switching; inexpensive lamps and ballasts; reduced glare from the fixtures; energy saving ballast; reduced heat generation; and dimmable.

The disadvantages are: multiple lamps and ballasts are required to achieve the lumens needed; lower voltage restriction means fewer units on a circuit; temperature sensitive lamps and ballast; the multiple lamps and ballasts required are expensive to maintain; and high cost for the multiple units required.

Linear fluorescent: the advantages are instant on; long lamp life and energy efficiency; multiple levels of switching; inexpensive lamps and ballasts; variable color temperatures; reduced lamp glare; energy saving ballast; reduced heat generation; and dimmable.

The obvious disadvantages are: multiple lamps and ballasts required to achieve lumens needed; multiple lamps and ballasts costly to install and maintain; temperature sensitive lamps and ballasts; and lower voltages means fewer units on a circuit. A more serious disadvantage for specific installations, however, it is the short life of the lamps. This is particularly important for high bay installations where accessibility is costly or for locations where accessibility for safety reasons is a concern such as in the vehicular traffic tunnels or under structures covering roadways.

SUMMARY OF THE INVENTION

The industrial lighting fixture contemplated according to the present invention utilizes induction fluorescent lighting in a new apparatus arrangement and departs substantially from the conventional concepts and designs taught and used by the prior art. In doing so, it provides an apparatus primarily developed for the purpose of overcoming the problems as described and enumerated above for various alternative types of lighting, but it accomplishes the result in a different and improved manner for producing more reliable trouble free high bay industrial lighting more conveniently and economically.

The use of induction fluorescent lighting in the present invention provides lamps with the longest life available and with the highest energy efficiency. The lamps are instant on with multiple switching. They can be provided in multiple color temperatures and provide a lamp with reduced glare. They utilize an energy efficient ballast with fewer parts to malfunction or fail providing greatly reduced maintenance costs and downtime. The lamps permit low/high temperature environment starting with low heat generation thereby effecting reduced heating, ventilating, and air-conditioning (HVAC) costs.

The disadvantages are initial cost and lower voltage restriction means fewer units on a circuit. The utilization of present induction fluorescent lighting means there are multiple lamps and ballast to install and maintain (offset by the longest lamp life available); and they are currently not dimmable.

In view of the foregoing known, obvious, and described disadvantages inherent in the known types of incandescent and fluorescent lamps presently existing in the prior art of industrial lighting, the present invention provides a new method, apparatus, and construction for induction fluorescent lighting fixtures wherein the same can be utilized to provide optimum long life high bay industrial lighting.

The present invention is an assembly apparatus for an induction fluorescent light fixture. It is comprised in part of a ballast subassembly for powering an induction fluorescent lamp. The fixture has means for securing the ballast subassembly to a building structure in a depending orientation. A central support post is provided which depends from the bottom of the ballast sub-assembly. A mounting tube surrounds the support post and is secured in position thereon by a clamp on the support post disposed below the lower end of the tube. At least one circular induction fluorescent lamp surrounds the mounting tube and has a support strap extending between the induction coils of the lamp with the ends of the strap secured to the coils. Means are provided for attaching the support strap to the mounting tube at the center of the strap.

The more important features of the invention have been broadly outlined in the proceeding summary in order that the detailed description thereof which follows may be better understood and in order that the present contribution to an improvement in the art of high bay fluorescent industrial lighting may be better appreciated. There are additional features of the invention that will be described hereinafter and which will form the subject matter of the claims appended hereto.

With respect to the claims hereof, and before describing at least one preferred embodiment of the invention in detail, it is to be understood that the invention is not to be limited in its application to the details of construction and to the arrangements of the components which are set forth in the following description or illustrated in the accompanying drawings. The invention is capable of being created in other embodiments and of being practiced and carried out in various ways. Also, it is to be understood that the phraseology and terminology employed here are for the purpose of description and should not be regarded as limiting.

As such, those skilled in the art in which the invention is based will appreciate that the conception upon which this disclosure is predicated may readily be utilized as a basis for the designing of other forms, structures, apparatus, systems, and methods for carrying out the several purposes of the present invention. It is important, therefore, that the claims be regarded as including such equivalent constructions in so far as they do not depart from the spirit and scope of the present invention.

Further, the purpose of the appended abstract is to enable the United States Patent and Trademark Office, and the public generally, and especially scientists, engineers and practitioners of the art who are not familiar with the patent and legal terms or phraseology, to determine quickly from cursory inspection the nature and essence of the technical disclosure of the application. The abstract is neither intended to define the invention of the specification, which is measured by the claims, nor is it intended to be limiting as to the scope of the invention in any way.

OBJECTS OF THE INVENTION

It is therefore an important object of the present invention to provide a long lived induction fluorescent lighting fixture which can also be utilized for high bay installations and other critical applications.

It is another object of the present invention to provide an induction fluorescent lighting fixture which permits a multiple of induction fluorescent lamps to be ganged into a single unit with optimum light dispersion and illumination from the multiple lamp arrangement.

It is a further object of the present invention to provide a multiple lamp induction fluorescent light fixture which can be installed in the most inaccessible and dangerous locations to service because of the long life of induction fluorescent lamps.

It is still another object of the present invention to provide a multiple lamp induction fluorescent lighting fixture which can be installed in the most inaccessible and dangerous locations to service because of the construction arrangement of the fixture which facilitates disassembly and service.

And it is yet a further object of the present invention to provide an induction fluorescent lighting fixture which can be disassembled in a multiple of ways from the bottom thereof to facilitate service and repair in relatively inaccessible locations.

Other objects and advantages of the present invention will become apparent when the method and apparatus of the present invention are considered in conjunction with the accompanying drawings.

DESCRIPTION OF THE DRAWINGS

The invention is illustrated in the accompanying drawings but not limited by reference to the particular embodiments shown therein of which.

DESCRIPTION OF THE PREFERRED EMBODIMENT

Reference is made to the drawings for a description of the preferred embodiment of the present invention wherein like reference numbers represent like elements on corresponding views.

Figure 1:
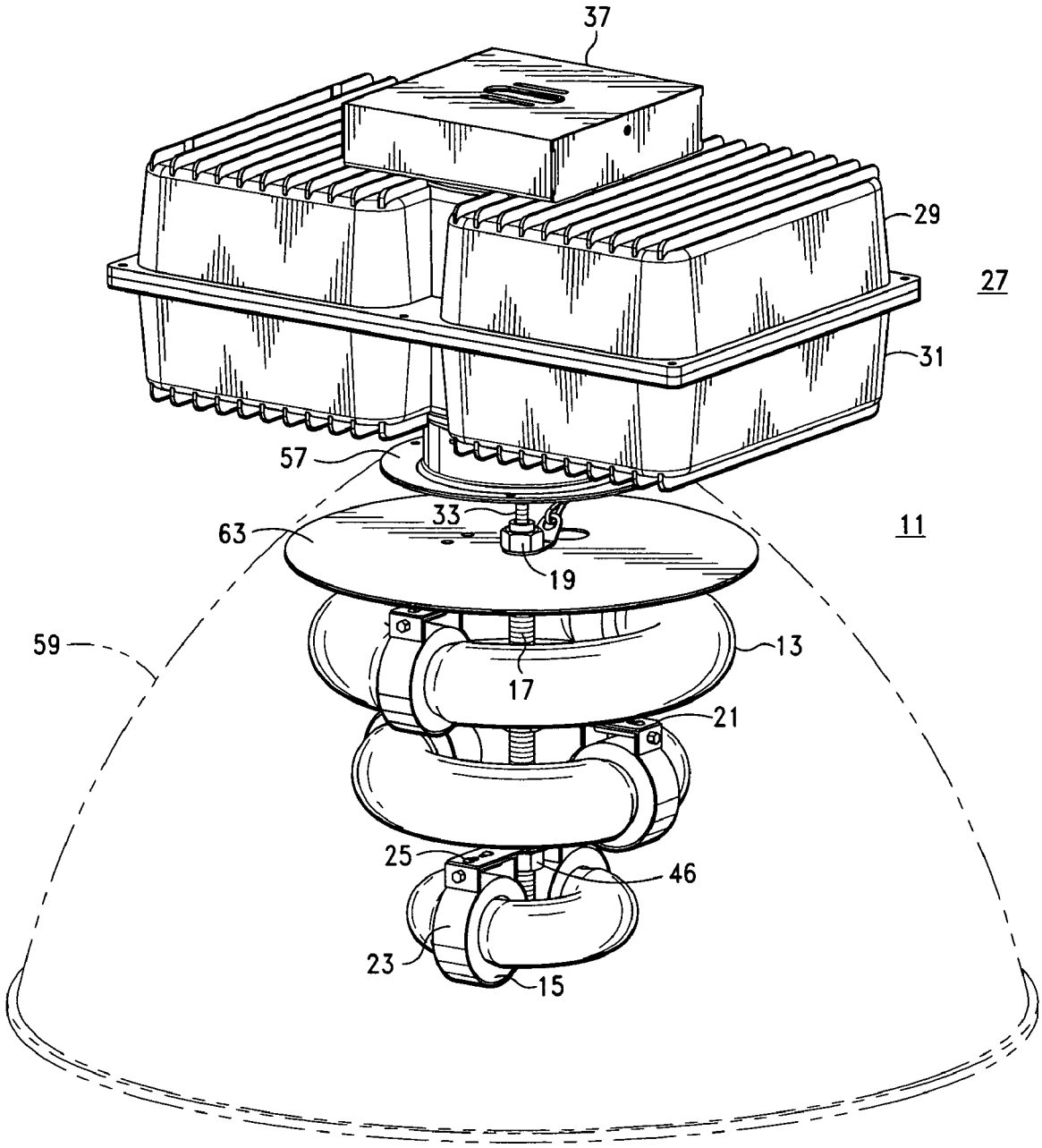
FIG. 1 is a perspective view of a three lamp induction fluorescent lighting unit of the present invention.

FIG. 1 is a perspective view of a preferred embodiment of the present invention which is an induction fluorescent three lamp industrial light fixture assembly 11 developed particularly for high bay industrial lighting. In a preferred embodiment of the invention, three circular independent induction fluorescent lamps 13 are utilized stacked in a predetermined configuration. Induction fluorescent lamps are high frequency light sources which follow the same basic principles of converting electrical power into visible radiation as conventional fluorescent lamps.

In comparison, conventional fluorescent lamps utilize electrodes to produce electrons which stimulate mercury vapor inside the fluorescent tube to emit UV radiation which in turn interacts with the fluorescent powder coated inside the lamp to convert it to visible light. The presence of the electrodes in fluorescent lamps has imposed many restrictions on lamp design and performance and is a major factor in limiting conventional fluorescent lamp life. The loss of cathode emission materials, due to evaporation and sputtering caused by ion bombardment, limits the life of fluorescent lamps to between 5000 to 20,000 hours.

The fundamental difference between induction fluorescent lamps and conventional fluorescent lamps is that induction lamps operate without electrodes. Induction, as used to describe or differentiate fluorescent lamps, means energy transfer through magnetism by a pair of external induction coils which surround the fluorescent tube at opposing positions and induce alternating magnetic fields in the mercury vapor in the tube. As in conventional fluorescent lamps, this produces the UV radiation to interact with the phosphor coating in the tube to convert it to visible light. Typical rated life of an induction lighting system is 100,000 hours. This is determined by the life of the electronic ballast and not the lamp components.

The present invention is an assembly apparatus for an induction fluorescent lamp fixture which interconnects a multiple of induction fluorescent lamps in a preferred predetermined configuration. While the induction fluorescent lamps of the present invention are shown as circular in configuration, rectangular, and oval induction fluorescent lamps are also available as well as some custom configurations. For the purposes of the present invention, the required configuration for the induction fluorescent lamp has a pair of induction coils disposed at opposing positions on the fluorescent tube which is a continuous (closed physical circuit) balanced configuration with the induction coils 15 disposed at opposing positions on the lamp tube.

The term circular, therefore, as used herein (and in the claims hereof) for describing the induction fluorescent lamps of the present invention, includes all induction fluorescent lamps having a pair of coils secured around the tube of the lamp, at opposing positions on a lamp tube that is a continuous loop, irrespective of the tube configuration, whether it be rectangular, oval, racetrack, or any other custom continuous shape. The diameter dimension on noncircular lamp tubes is a measurement of the same dimension in the plane of the tube on similar shaped tubes.

Figure 2:
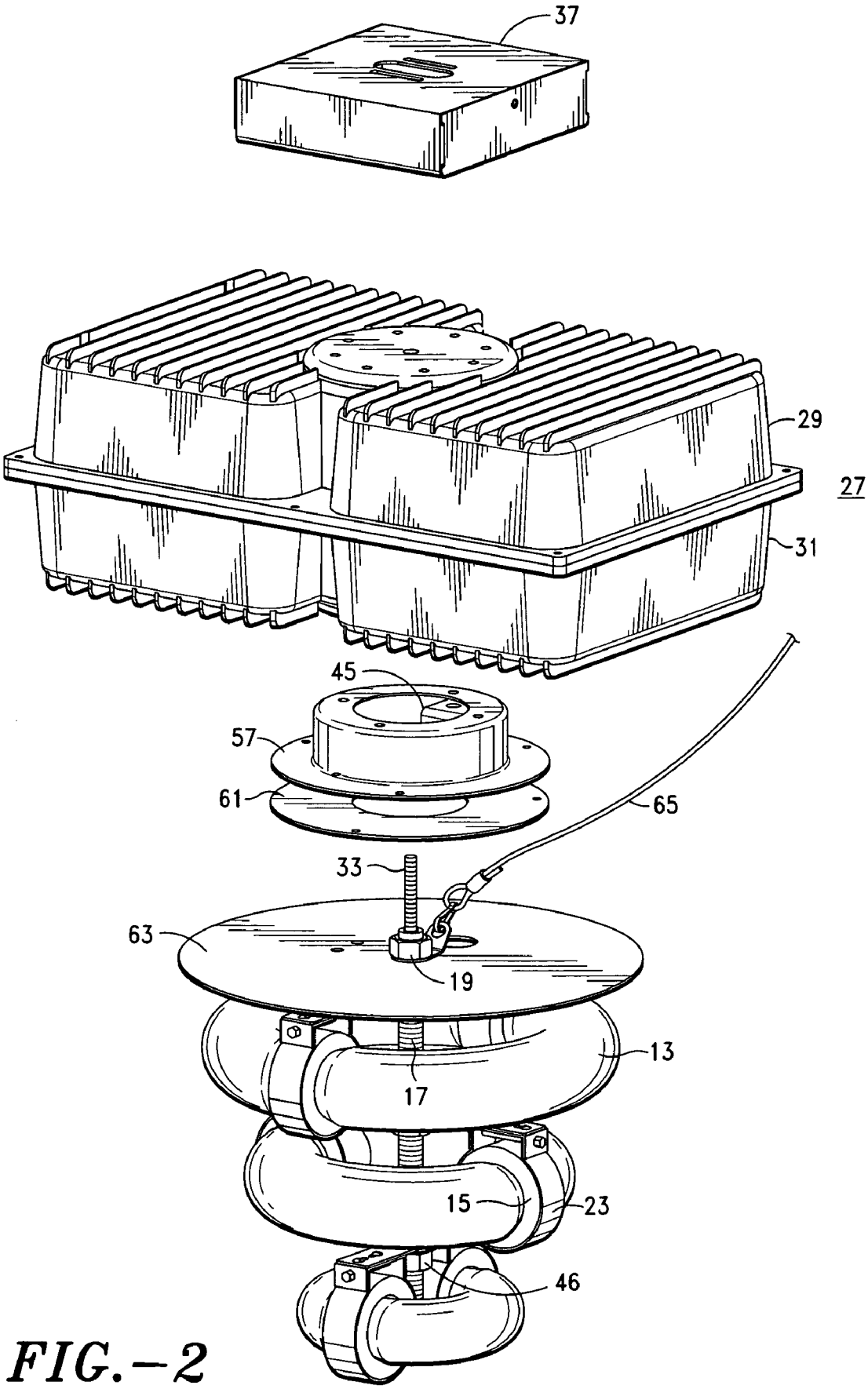
FIG. 2 is a is an exploded view of FIG. 1.
Figure 3:
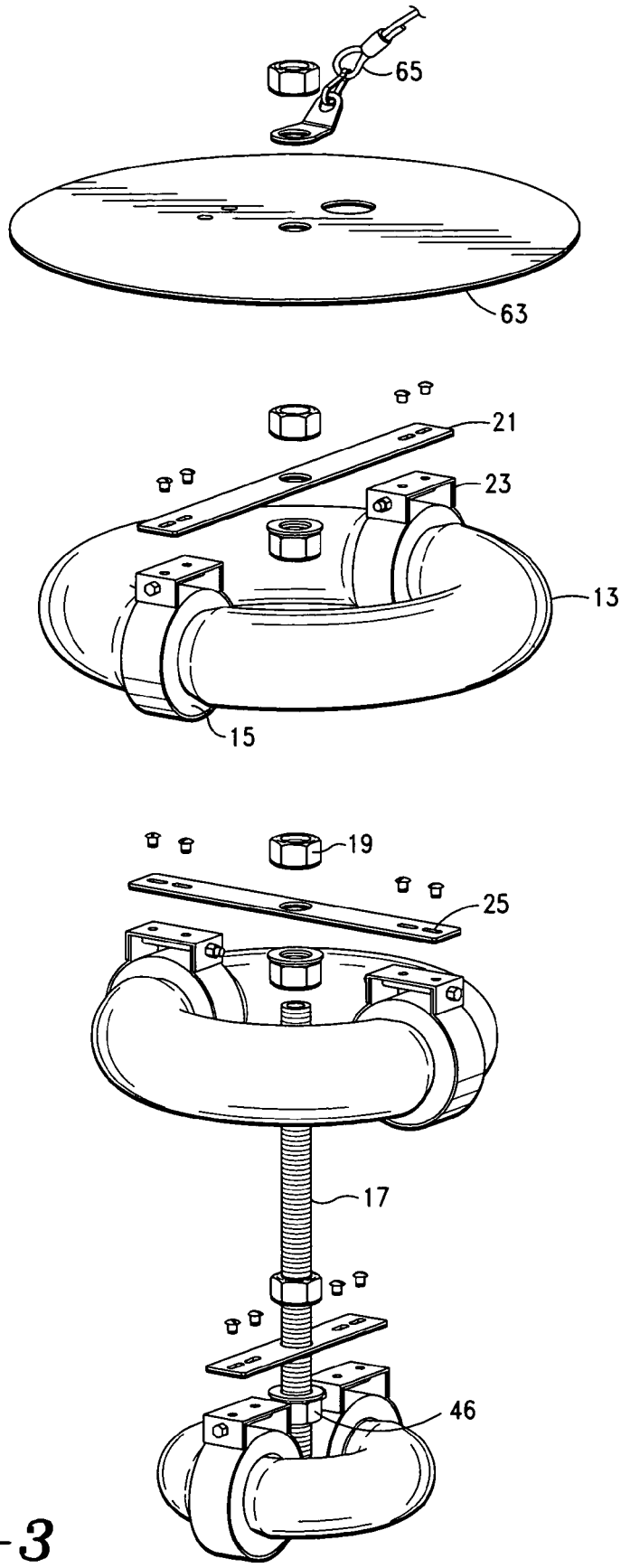
FIG. 3 is an exploded view of the three lamp assembly.

Reference is made to FIGS. 1-3 which illustrate the following description of the invention. In the preferred embodiment of the invention, at least one circular induction fluorescent lamp 13 is secured to a mounting tube 17 which in operative position suspends vertically. The mounting tube is threaded externally for the length thereof whereby threaded nuts 19 can be engaged thereon and the induction fluorescent lamps can be fixed at predetermined but adjustable positions there along. The nuts are disposed on opposite sides of support straps 21 secured to the lamps and tightened against the straps to clamp the support straps between the nuts in vertically spaced relation along the mounting tube.

In order to connect the induction fluorescent lamp 13 to the mounting tube 17, a support strap 21 is provided which extends between the induction coils 15 of the lamp with the ends of the strap secured to the coils. A pair of clamps 23 are secured to the induction coils of each lamp and provided with aligned mounting surfaces for attachment of the strap there between. Holes 25 are provided at the ends of the strap to permit self tapping screws to engage the mounting surfaces of the clamps and secure the ends of the strap to the clamps.

Alternatively, the strap 21 and the end clamps can be comprised of an integral unit which extends across the lamp tube and clamps the ends of the strap around the coils. Other forms of mechanism for engaging the strap with the clamps could include riveting, adhesive joining, and other forms of mechanical interconnection which are well-known. Likewise, other simple forms of straps and clamps for engaging the coils of the tube, to provide a strap interconnection which can engage a central mounting tube, are of obvious constructions and contemplated by the invention.

The support strap 21 necessarily includes means for attaching it to the mounting tube 17 at the center of the strap whereby the lamp can be mounted on the tube in a plane perpendicular thereto and parallel to the ground. The plane of the lamp contains the linear axis of the tube thereof which in most induction fluorescent lights is circular, oval, or rectangular. The plane of the fluorescent lamp tube is parallel to a surface on which a circular or rectangular lamp can be laid flat. The mounting tube attaching means is a receptacle in the center of the strap to permit the mounting tube to extend therethrough.

In the preferred embodiment of the invention, a multiple of induction fluorescent lamps 13 are secured to the mounting tube in a nested preferred array in the same manner as described infra for an individual lamp. The lamps have different diameters in the plane of the fluorescent tube of the lamps. They are located at predetermined intervals of separation on the mounting tube; each lower lamp having a smaller diameter in the plane of the fluorescent tube.

This orientation, and the overlapping of the higher lamp tubes, in which the higher tube extends beyond periphery of the lower tube, provides a maximum amount of lamp tube exposure. Illumination from each lamp is projected outward and downward beyond the tube below it, and from the light assembly, for optimum light dispersion. In other words, the array can be described as the lamps having different diameters in the plane of the fluorescent tube of the lamp with the lamps arranged in descending order of diameter around a central axis from top to bottom of the resulting array. This description is applicable to other shapes of different sized induction fluorescent lamp tubes stacked in an array as contemplated by the present invention.

Figure 4:
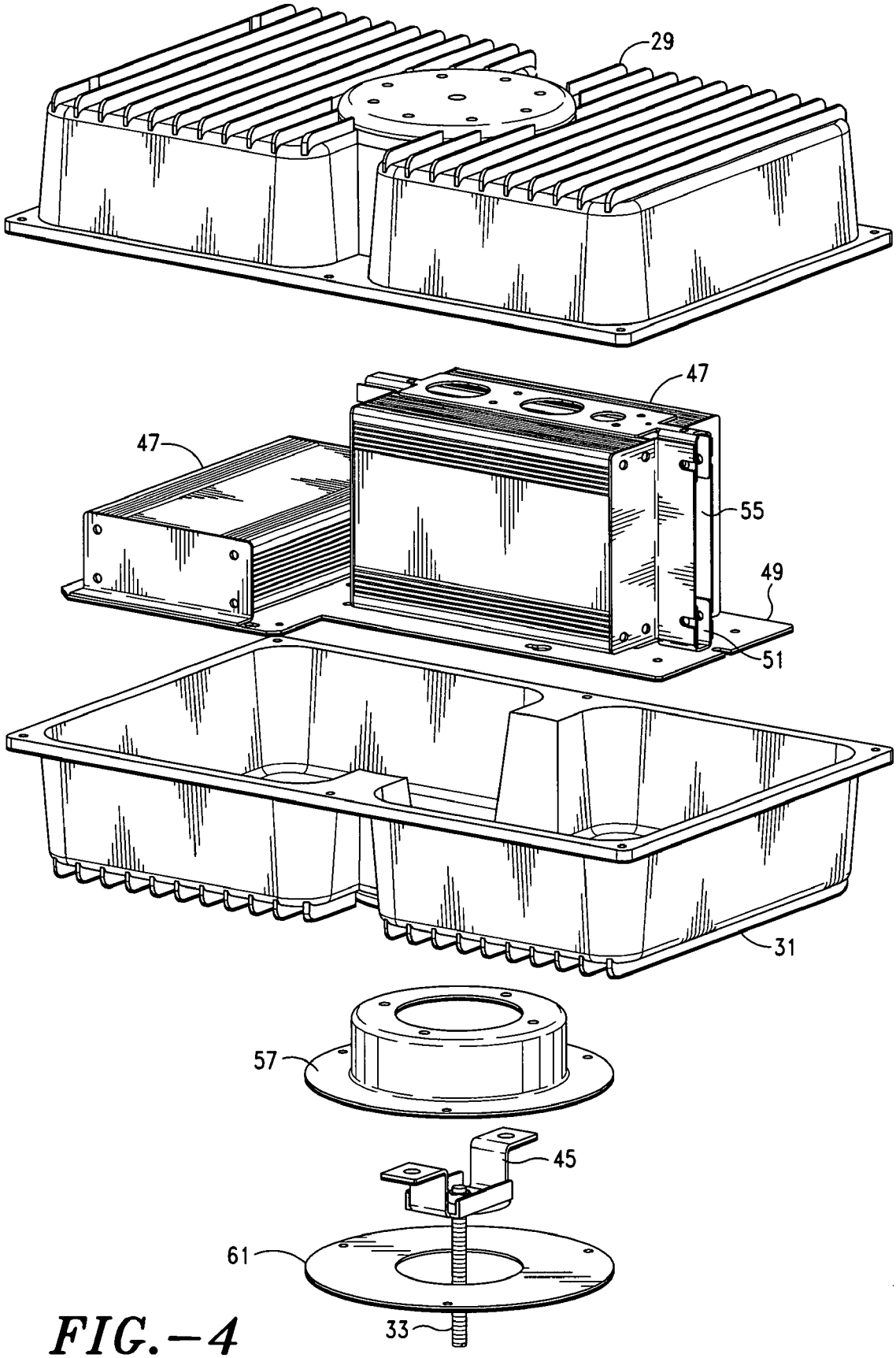
FIG. 4 is an exploded view of the ballast assembly and its container.

A ballast sub-assembly 27 includes a ballast container housing a ballast for each lamp in the light fixture assembly for powering the induction fluorescent lamps. A means is provided for securing the ballast sub-assembly to a building structure in a depending orientation. Reference is made to FIG. 4 which shows an exploded view of a preferred embodiment of a custom-made ballast box for the present invention. It includes a two-piece container having top and bottom sections 29, 31 which are mirror images made of cast aluminum and having cooling fins disposed on the external surfaces thereof for heat dissipation. The bottom section of the ballast container has means in the form of a receptacle for engaging a support post 33 at the center of the bottom surface thereof. The top and bottom ballast container sections are secured together by nuts and bolts around periphery thereof.

Figure 7A:
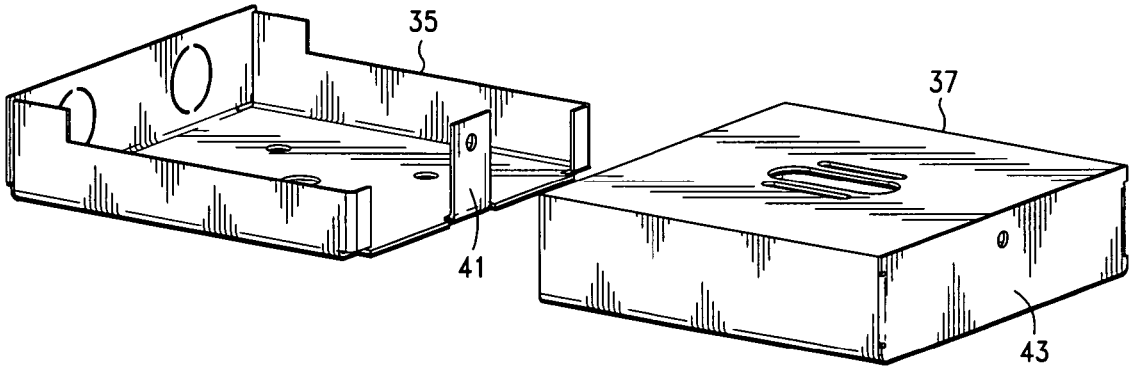
FIG. 7 is an exploded view of the lighting assembly connection/hanger box.
Figure 7B:
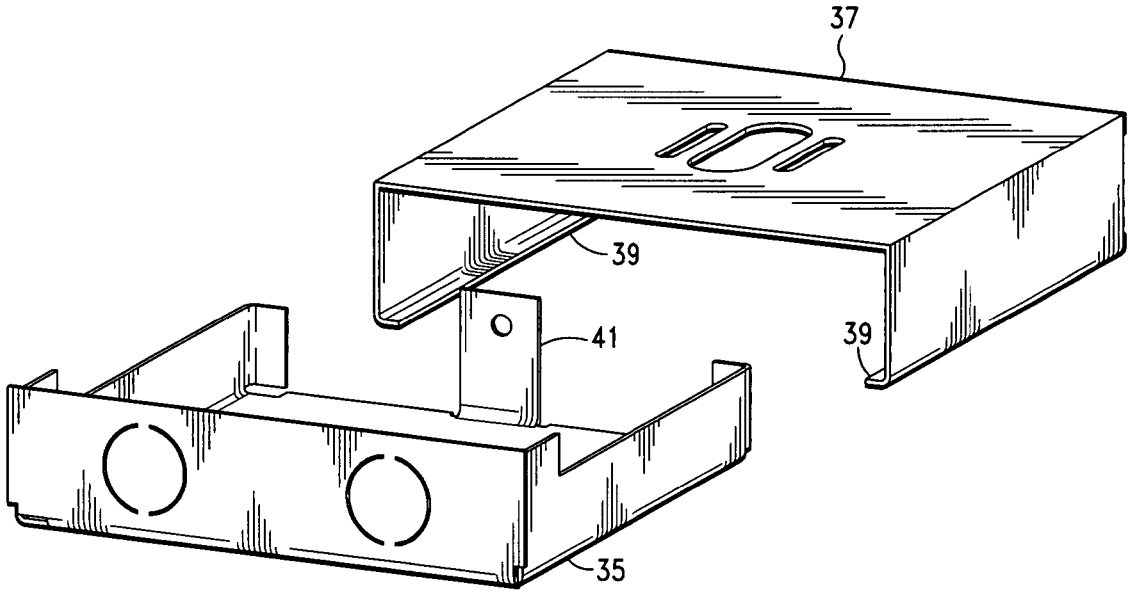

The top section 29 of the ballast container has means in the form of a two-piece box connector for securing the container to a building structure. Reference is made to FIGS. 7*a* & 7*b* which show the two-piece connector. The lower or tray portion 35 of the two piece connector is formed for securement to the ballast container top section for containing electrical wire connectors for powering the light fixture ballasts in the container.

The cover or upper portion 37 of the two-piece connector box, which is formed for securement to a building structure, contains the ends of the electrical wires which provide power to the ballast container. The lower edges of the upper cover are provided with inwardly projecting horizontal flanges 39 which form a partial shelf and support the connector lower tray 35 thereon. The two-piece connector box permits securing the light fixture to a portion of the building structure, such as a horizontal ceiling beam, whereby when the connector box upper and lower portions are interlocked, the ballast container top section is secured to the building structure.

The lower tray portion 35 of the connector box is provided with a simple means for engaging the upper cover to secure the tray therein when it is inserted into the upper cover to hold the light fixture in engagement with the upper cover. The cover engaging means can include a vertical tab 41 on the tray which abuts the interior rear wall 43 of the upper cover when the cover is assembled in a male-female relationship with the tray. A self tapping screw projects through the rear wall of the upper cover to engage the tab on the lower tray to hold the unit together and to thereby secure the light fixture to the upper cover and thereby to the building structure.

The two-piece connector box allows the upper or cover portion thereof 37 to be installed during building construction and wired for receiving the electrical lighting fixture. When the light fixture is to be hung, the wires are connected and the connector box cover and tray 35 engaged which in turn effectively suspends the light fixture 11 in operative position. The two-piece connector box greatly simplifies light fixture installation in locations of relative inaccessibility.

Reference is made to FIGS. 1-4. A central support post 33 is formed for engaging a receptacle on the bottom surface of the ballast container bottom section 31 to depend therefrom. The receptacle is in the form of a winged bracket 45 which has holes in the wings thereof for studs or bolts to project there through for engagement with the lower surface of the ballast container bottom section proximate to the center thereof to secure the bracket to the ballast container. The bracket has an opening in the center thereof to permit the upper end of the support post to project therethrough.

The support post 33 has screw threads formed at least on the upper end thereof for engagement with the winged bracket 45, and it has a lower end formed for engaging a clamp. The support post can be secured to the bracket by having the threaded upper end projecting through the opening in the center thereof and having threaded nuts tightened thereon on opposite sides of the bracket opening thereby clamping the shaft to the bracket and forming a depending support post. The lower end of the post is formed for engaging the clamp to support the hollow mounting tube 17 on the post above the clamp. In a simple form of the clamp 46, the lower end of the post is also threaded to engage a nut which forms the clamp on the post holding the mounting tube on the post above the nut. The post in its simplest form is a length of threaded rod.

When the light fixture is assembled, a multiple fluorescent tube array secured to the mounting tube 17 is slid up onto the depending support post 33 and secured in position thereon by the clamp secured to the lower end of the post. Other forms of support post and clamp can be employed to suspend the mounting tube.

Figure 5:
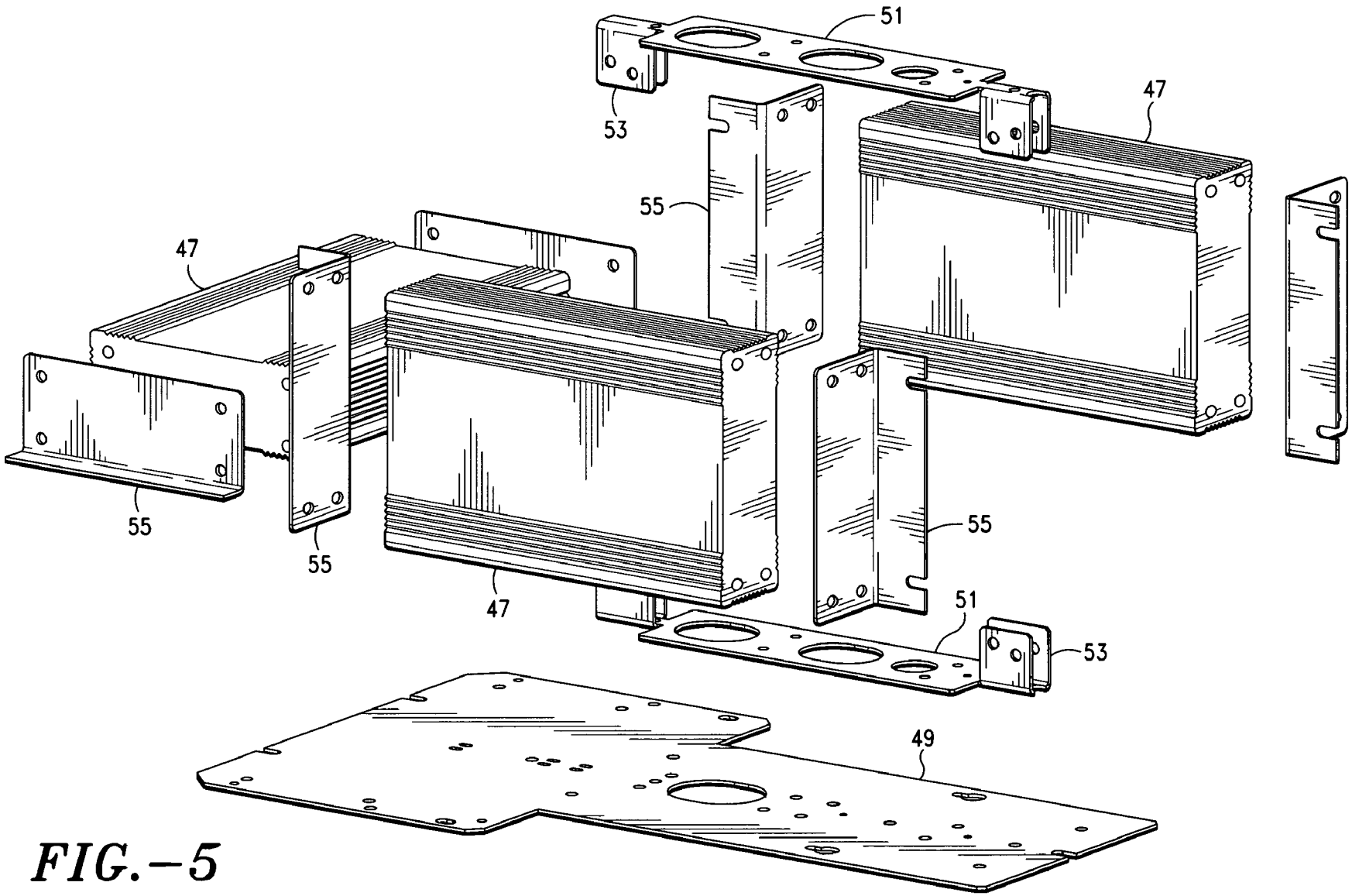
FIG. 5 is a exploded view of the ballast units and supporting structure.

The ballasts 47 for the fluorescent lamps 13 are disposed between the ballast container top and bottom sections 29, 31 and secured together by connector plates, shown in FIGS. 4 & 5, which in turn are secured to the internal surface of the bottom section of the ballast box by self tapping screws projecting through the lower horizontal base plate 49 thereof. Other connector plates hold the ballasts in predetermined spaced relation on the lower base plate for cooling purposes and to fit within the ballast box.

In the preferred three lamp light fixture of the present invention, the connector plates for the required three ballasts 47 include two spacer plates 51 having U shaped brackets 53 at the ends thereof to which ballast end connector plates 55 are secured. The spacer plates are provided with openings for cooling airflow and an opening in the lower of the spacer plates aligns with certain openings in the base plate 49. The two spacer plates are identical for economy, so that either can be used as the top or bottom spacer plate, and have multiple openings for maximum airflow between the opposing ballasts secured on opposite sides of the spacer plates. The end connector plates 55 are right angle brackets which secure to the ends of the ballasts and to the spacer plates. A third ballast is secured between a pair of end connector plates and mounted on the base plate at an elevated position thereon to allow air cooling flow thereunder.

Reference is made to FIG. 4. A lower adapter fitting 57 can be secured to the exterior bottom surface of the ballast container bottom section 31 surrounding the winged bracket 45 and the support post 33. The fitting is provided with holes for securement thereof to the bottom of the ballast container by self tapping screws or bolts which engage tapped holes in the bottom section.

A reflector shield 59 can be secured to, or positioned below, the adapter fitting 57 and held in place by bolts which project through the shield to engage the adapter fitting or by other means which secure the shield to the ballast sub-assembly 27 disposed there above. Shown in FIG. 6 of the drawings is a support plate 61 which fits internally of the shield and screws to the adapter fitting. The reflector can be a metal or plastic shield or an acrylic, polycarbonate, or glass lens or inverted bowl light diffuser depending upon the application or requirement.

A reflector plate 63 can be secured to the top of the mounting tube 17 adjacent to the support strap 21 which is secured to the top fluorescent lamp 13 in the array. The reflector plate is secured to the mounting tube by nuts 19 disposed on opposite sides of the plate. The plate is located between the adapter fitting 57 for the reflector shield 59 and the top induction fluorescent lamp of the array of multiple lamps.

A primary feature of the design of the light assembly apparatus of the present invention is its ease of disassembly for service while suspended in a relatively inaccessible location. Disassembly of the unit from its operative position is progressive by unit or by module whereby the lamp assembly can be taken apart from the bottom: either partially disconnected and a module thereof containing the lamps suspended in place for service or the ballast container separated for changing the ballasts while leaving the rest of the assembly intact. This design permits the ballast box to be opened for the exchange of ballasts or the whole ballast box to be taken down by separation of the two piece top adapter plate. This design permits any portion of the light assembly to be serviced by progressive or modular disassembly.

Figure 6:
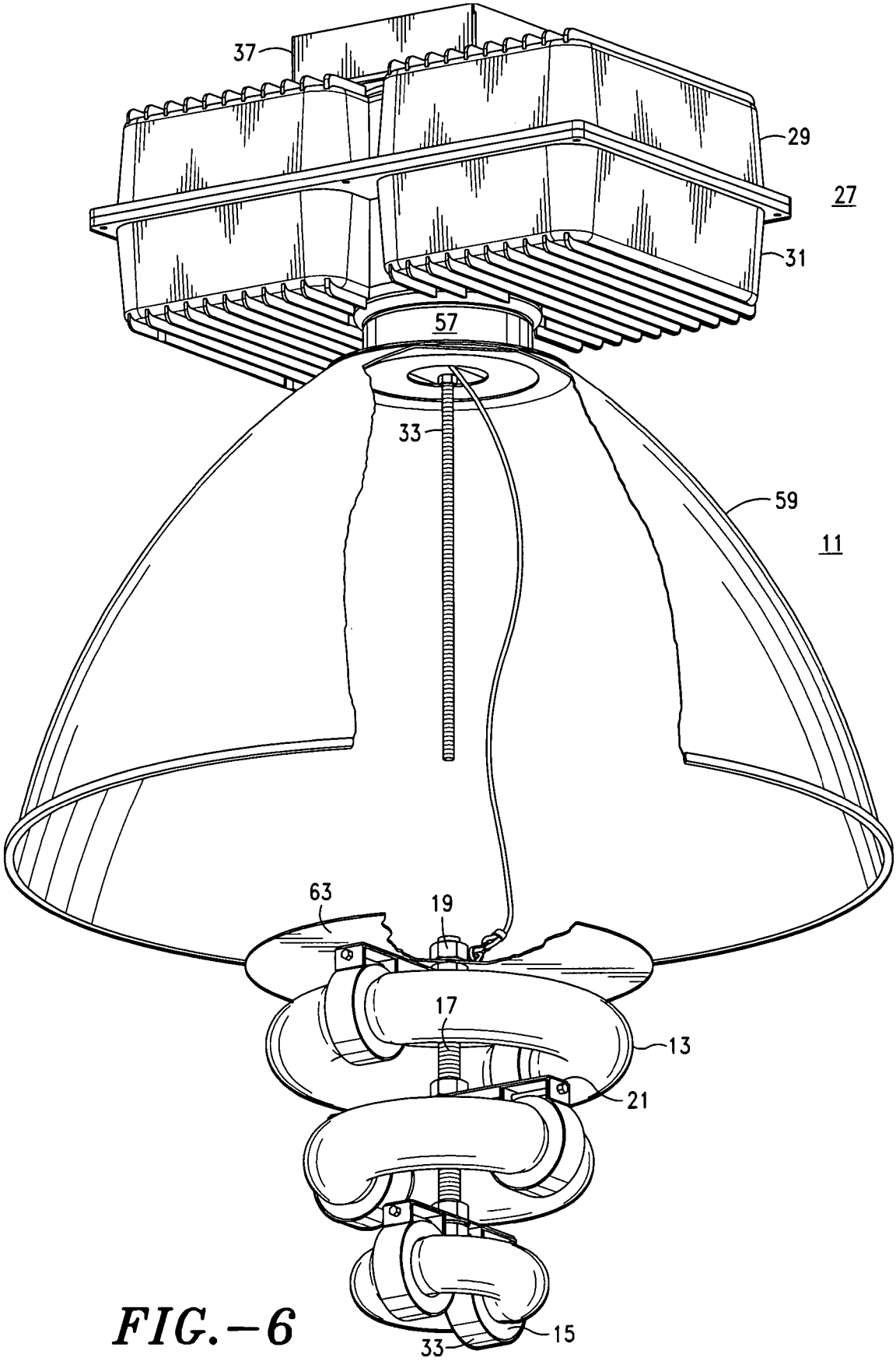
FIG. 6 is an exploded view showing anchoring system of the three lamp assembly.

Reference is made to FIG. 6. A lanyard 65 extends between a connection to the ballast box and a connection to the top of the mounting tube of the lamp assembly. This permits dropping the induction fluorescent lamp assembly of the light fixture for exchanging lamps with a safety cord which prevents the lamp assembly from falling. The assembly can hang at the end of the lanyard while the exchange or repair of the lamps is effected or other service performed.

The induction fluorescent lamp assembly of the present invention solves the main problem of induction lighting which is that only lower wattage induction fluorescent lamps are available. This solution is the multiple lamp array of the present invention. It permits the 100,000 hour life of the induction fluorescent lamps to the employed with the 99 power factor and which provide a wide range of color temperatures (2700K-6400K). The induction lamps have an instant start as at low temperatures as low as −35° C. They have instant restrike capability in a wide operating temperature of −35° C. to 90° C. The system provides 80-95 lumens per watt with excellent lumen maintenance which is 100% flicker free. The bulbs have excellent CRI (color rendering index) of 80-95 which permits a 10-year limited warranty on all components.

Thus it will be apparent from the foregoing description of the invention in its preferred form that it will fulfill all the objects and advantages attributable thereto. While it is illustrated and described in considerable detail herein, the invention is not to be limited to such details as have been set forth except as may be necessitated by the appended claims.

I claim:

1. An assembly apparatus for an induction fluorescent light fixture comprising a ballast subassembly for powering an induction fluorescent lamp and having means for securing said subassembly to a building structure in a depending orientation, a central support post depending from the bottom of said ballast sub-assembly, a mounting tube surrounding said support post and secured in position thereon by a clamp on said support post disposed below the lower end of said tube, at least one circular induction fluorescent lamp surrounding said mounting tube and having a support strap extending between the induction coils of said lamp with the ends of said strap secured to said coils, and means for attaching said support strap to said mounting tube at the center of said strap.

2. The assembly apparatus of claim 1 including a multiple of said circular induction fluorescent lamps secured to said mounting tube, said lamps having different diameters in the planes of the fluorescent tubes of said lamps respectively with said lamps arranged in descending order of diameter around a central axis from the top to the bottom of a resulting array of said multiple lamps, said ballast subassembly containing an equal number of ballasts as said multiple of lamps.

3. The assembly apparatus of claim 2 wherein said mounting tube is threaded externally for the length thereof and said induction fluorescent lamps are positioned thereon by threaded nuts engaged with said tube, said nuts being disposed on opposite sides of each of said support straps of said lamps respectively to clamp said straps between said nuts in spaced relation along said mounting tube.

4. The assembly apparatus of claim 2 including an adapter fitting secured to the bottom of said ballast sub-assembly and surrounding said central support post to permit a reflector shield to be secured thereto.

5. The assembly apparatus of claim 4 wherein a reflector plate is secured to said mounting tube disposed between said adapter fitting and the top induction fluorescent lamp of said array of multiple lamps.

6. The assembly apparatus of claim 2 wherein said ballast sub-assembly includes a two-piece container having top and bottom sections with said top section including means for securing said container top section to a building structure, said support post being engaged to the center of the bottom surface of said bottom section, and ballasts for said induction fluorescent lamps being disposed between said ballast container top and bottom sections.

7. The assembly apparatus of claim 6 wherein said means for securing said ballast container top section to a building structure is a two piece connector box having a lower tray portion secured to said ballast container top section for containing electrical wire connectors, and said connector box having an upper portion formed for securement to a building structure whereby when said upper and lower connector box portions are interconnected said ballast container top section is secured to said building structure.

8. The assembly apparatus of claim 7 wherein said two piece ballast container includes top and bottom sections which are mirror images made of cast aluminum and have cooling fins disposed on the external surfaces thereof, said ballast container top section having said two-piece connector box lower tray portion secured thereto, said ballast container bottom section being provided with a receptacle for engaging said depending central support post, and said support post having screw threads formed on the upper end thereof for engaging said receptacle on said ballast container bottom section and a lower end thereof formed for engaging said clamp.

9. The assembly apparatus of claim 6 wherein said ballast subassembly includes said multiple ballasts mounted in spaced relation by connector plates and secured to said container.

10. The assembly apparatus of claim 1 wherein said support strap secured to said induction fluorescent lamp is comprised of a pair of clamps disposed one on each of said induction coils of said lamp, said clamps each including aligned mounting surfaces for attachment of said straps for attachment between said clamps having a receptacle in the center of the length thereof for receiving said mounting tube therethrough.

11. The assembly apparatus of claim 1 including an adapter fitting secured to the bottom of said ballast subassembly and surrounding said central support post for supporting a reflector shield secured thereto.

12. The assembly apparatus of claim 1 including a reflector plate secured to said mounting tube disposed between said ballast subassembly and said induction fluorescent lamp.

13. The assembly apparatus of claim 1 including a lanyard secured between said ballast subassembly and said mounting tube at the top end thereof.

14. An assembly apparatus for an induction fluorescent light fixture comprising a two-piece ballast container having mirror image top and bottom sections made of cast aluminum and have cooling fins disposed on the external surfaces thereof, said ballast container top section having a two-piece box connector lower portion secured proximate to the center of said container top section for containing electrical wire connectors, said box connector including a disengageable upper portion formed for securement to a building structure whereby when said upper portion is secured to a building structure, and said connector upper and lower portions are interconnected, said ballast container top section is secured to said building structure, said ballast container bottom section being provided with a receptacle proximate to the gravity center on the external lower surface of said bottom section for engaging a depending central support post, ballasts for said induction fluorescent lamps being mounted in spaced relation for cooling by connector plates and disposed between said ballast container top and bottom sections and secured to said bottom section, said central support post having means formed on the upper end thereof for engaging said receptacle on the bottom of said ballast container bottom section, said support post having a lower end formed for engaging a clamp, an externally threaded mounting tube surrounding said support post and secured thereon by said clamp disposed below the lower end of said tube, a multiple of circular induction fluorescent lamps surrounding and secured to said mounting tube by support straps extending between the induction coils of said lamps with the ends of the straps secured to said coils, said straps having a receptacle at the center thereof for permitting said mounting tube to extend therethrough, said lamps being positioned on said mounting tube by nuts threadably engaged to said mounting tube and disposed on opposite sides of said straps of said lamps respectively, said lamps having different diameters in the planes of the fluorescent tubes of said lamps respectively with said lamps being arranged in descending order of diameter around a central axis from the top to the bottom of the resulting array of said induction lamps, an adapter fitting secured to the bottom section of said ballast sub-assembly surrounding said central support post for supporting a reflector shield to be secured thereto, said reflector shield secured to said adapter fitting, a reflector plate secured to said mounting tube disposed between said adapter fitting and the top induction fluorescent lamp of said array of multiple lamps, and a lanyard extending between said ballast container and the upper end of said mounting tube.

* * * * *